United States Patent [19]

Mombers

[11] 3,944,700

[45] Mar. 16, 1976

[54] METHOD OF MANUFACTURING POLYAMIDE COATED TEXTILE MATERIAL AND TO THE TEXTILE MATERIAL MADE ACCORDING TO THE METHOD

[75] Inventor: Wilhelmus L. R. Mombers, Waalwijk, Netherlands

[73] Assignee: L. Mombers B.V., Waalwijk, Netherlands

[22] Filed: Apr. 19, 1974

[21] Appl. No.: 462,576

[30] Foreign Application Priority Data

June 22, 1973 Netherlands ..... 7308704

[52] U.S. Cl. ..... 428/260; 427/341; 428/290; 428/474

[51] Int. Cl.². B32B 27/12; B05D 3/10; B32B 27/34

[58] Field of Search ..... 260/30.8 R; 117/62, 161 P, 117/130.5 A; 427/341; 428/260, 290, 474

[56] References Cited

UNITED STATES PATENTS

| | | | |
|---|---|---|---|
| 2,311,587 | 2/1943 | Vaala | 260/30.8 R |
| 2,317,728 | 4/1943 | Bristol | 117/161 P |
| 2,320,088 | 5/1943 | Leekley | 260/30.8 R |
| 2,334,186 | 11/1943 | Fox | 260/30.8 R |
| 2,342,370 | 2/1944 | Richter | 260/30.8 R |
| 2,610,927 | 9/1952 | Foulds | 117/161 P |
| 3,167,446 | 1/1965 | De Nijs | 117/161 P |

FOREIGN PATENTS OR APPLICATIONS

| | | |
|---|---|---|
| 136,749 | 2/1973 | Netherlands |

*Primary Examiner*—Ralph Husack
*Assistant Examiner*—Janyce A. Bell
*Attorney, Agent, or Firm*—Karl W. Flocks

[57] ABSTRACT

A method of manufacturing polyamide coated textile material comprises treatment of textile material with a solution of polyamide and benzene sulphonic acid n-butylamide as plasticizer in formic acid followed by contacting the textile material with water in order to precipitate the polyamide on the textile material.

4 Claims, No Drawings

METHOD OF MANUFACTURING POLYAMIDE COATED TEXTILE MATERIAL AND TO THE TEXTILE MATERIAL MADE ACCORDING TO THE METHOD

This invention relates to improvements in a method of manufacturing polyamide coated textile material and to the textile material made according to the method.

The Netherlands Pat. Specification No. 136 749 describes a method of manufacturing a polyamide coated textile material, and in particular artificial leather and in which a cohesive basic layer, comprising uneven textile fibers, is treated with a solution of a polyamide and a plasticizer in a mixture of formic acid and a solvent for the plasticizer, the solvent being mixable with water and formic acid. On termination of treatment, the textile material is brought into contact with water whereby polyamide and the plasticiser precipitate. As a plasticizer tricresylphosphate and dibutylphtalate in a quantity of 10 to 50% by weight calculated plasticizer is used. A suitable solvent for the plasticizer on the basis of the polyamide is acetone.

It has been found that the mechanical characteristics, and in particular that of resistance to wear, of the textile material coated with a polyamide leaves much to be desired. With fiber webs treated in the manner foregoingly described, the attendant disadvantages occur of different products being obtained especially when the product is split into several layers, with different degrees of resistance to wear.

It has been found that these disadvantages are eliminated when, during treatment, the solvent is dispensed with and benzene sulphonic acid n-butylamide is employed.

The present invention is directed to a method of manufacture of polyamide coated textile material in which a cohesive basic layer comprising textile fibres of random types are treated with a solution of a polyamide and a plasticizer in formic acid and whereafter the polyamide, with the aid of water, on the basic layer is precipitated, and characterised in this that as a plasticizer benzene sulphonic acid n-butylamide is employed.

According to the present invention, the plasticizer employed is marketed by the Badische Aniline and Soad Factory under the name "Plastomoll BMB".

As polyamides, which can be employed in accordance with the invention, all those of polyamides which are soluble in formic acid come into consideration.

According to the present invention, the method lends itself to the treatment of fiber webs in particular. In a treated fibre web, the polyamide is evenly distributed so that all the products obtained have consistent characteristics in the matter of resistance to wear as far as the mechanical characteristics are concerned. Furthermore, the method according to the invention is applicable to the treatment of raw cotton fibres while also woven material can be treated.

The present method is effected by dissolving the polyamide and the plasticizer in formic acid, the quantity of plasticiser is preferably 10 to 100% by weight calculated on the basis of the polyamide. Furthermore materials can be added to the polyamide to make it resistant to light, oxygen and micro-organisms. A suitable binder to increase resistance to light is manganese sulphate; copper binders may be employed to combat the destructive effects of microorganisms. After the textile material has been impregnated with the desired quantity of polyamide, the material is brought into contact with water, whereupon the polyamide coagulates. Following this it is washed with water and finally dried.

The content of the coagulating bath can entirely comprise water wherein a basic reagant medium such as sodium carbonate, sodium hydroxide or potassium hydroxide, or ammonia can be added.

Material can be added which preferably reacts with formic acid under the generation of gas, for example sodium carbonate or ammonium carbonate, and through which the polyamide obtains a porous structure which, for certain applications, is highly suitable. The resistance to wear is not unfavorably influenced by the foam structure.

EXAMPLE I.

15 parts by weight of polycaprolactam yarn waste is discharged into 100 parts by weight of an 80% solution of formic acid in water. 7.5 parts by weight of "Plastomoll BMB", 0.05 parts by weight of manganese sulphate and 1.3 parts of aniline coloring medium are then added. Cotton fibers having a weight of 180 grams/centimeter$^2$, and a fiber web having a weight of 327 grams/centimeter$^2$ are then fed through the solution. The fibers are successively smoothed down by feeding through two knife edges, and freed of superfluous liquid by squeezing, then immersed in water of a temperature of 10°C whereby the polycaprolactam coagulates. After termination of this process the fibers are washed in water and, following this, dried. In this manner the treated fibres become soft, supple and extremely wear resistant.

EXAMPLE II.

The treatment as described in Example I is repeated but with this difference however, that 7.5 parts by weight of acetone is added. The treated fibers were less soft and resistant to wear than the fibers treated by the method of Example I.

EXAMPLE III.

A fiber web and a cotton weave treated in accordance with the present method of example I, and a fiber web and a cotton weave which were treated in accordance with the method of Netherlands Pat. Specification No. 136 749 were subjected to rubbing tests on a friction generating apparatus in which the materials are tensioned over a platform, stretched 10% and then subjected to the backward and forward rubbing action of a weight thereon, for example of 500 grams, having affixed thereunder a rubber strip of between 1.5 and 0.3 centimeters thick. The rubbing actions were continued until the cotton weaves became visible and a hole in the fiber web appeared. With the cotton weave treated in accordance with the Netherlands Pat. Specification No. 136,749 method and in accordance with the present method, 75 and 212 rubbing actions were required respectively to make the weaves visible. For the fiber webs 920 and 1200 rubbing operations were required, respectively. From these results it has been found that the weaves and fiber webs treated according to the method of the present invention exhibit a higher degree of resistance to wear.

EXAMPLE IV.

In comparing the treatments of the fiber webs as described in the method of example III with that of Examples I and II, the result was that after 1160 and 600 respectively rubbing actions a hole became visible.

I claim:

1. In a method of manufacturing polyamide coated textile material in which a cohesive basic layer, comprising textile fibers of random types, is treated with a solution of a polyamide and a plasticizer in formic acid and whereafter the polyamide is precipitated by contact with a water coagulation bath, the improvement wherein benzene sulphonic acid n-butylamide is employed as said plasticizer and said formic acid is the only solvent present in said solution.

2. A method as claimed in claim 1, wherein the plasticizer is employed in a quantity of 10 to 100% by weight calculated on the basis of the polyamide.

3. A method as claimed in claim 1, wherein the water coagulation bath contains a compound which generates a gas by reaction with formic acid.

4. A polyamide coated textile material manufactured by the method of claim 1.

* * * * *